US007553004B2

(12) United States Patent
Kachi

(10) Patent No.: US 7,553,004 B2
(45) Date of Patent: Jun. 30, 2009

(54) INK-JET RECORDING APPARATUS, INK CONTAINER, AND METHOD OF FILLING INK CONTAINER

(75) Inventor: Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 450 days.

(21) Appl. No.: 11/389,077

(22) Filed: Mar. 27, 2006

(65) Prior Publication Data

US 2006/0215000 A1 Sep. 28, 2006

(30) Foreign Application Priority Data

Mar. 28, 2005 (JP) ..... 2005-092255

(51) Int. Cl.
*B41J 2/175* (2006.01)
*B41J 2/195* (2006.01)
*B41J 29/38* (2006.01)

(52) U.S. Cl. ..... 347/85; 347/7; 347/17; 347/93

(58) Field of Classification Search ..... 347/85, 347/86, 7, 17, 93
See application file for complete search history.

(56) References Cited

U.S. PATENT DOCUMENTS 5,912,688 A * 6/1999 Gragg ..... 347/86
6,802,584 B2 * 10/2004 Kageyama ..... 347/14
6,935,729 B2 * 8/2005 De Marco et al. ..... 347/73
6,973,409 B1 * 12/2005 Shimizu et al. ..... 702/173

FOREIGN PATENT DOCUMENTS

JP 2003-300331 A 10/2003

* cited by examiner

*Primary Examiner*—An H Do
(74) *Attorney, Agent, or Firm*—Birch, Stewart, Kolasch & Birch, LLP

(57) ABSTRACT

An ink-jet recording apparatus has a recording head that discharges ink from a nozzle to print an image. An ink container consisting of an ink bag and a case is placed above the recording head to supply the ink. A micro pump is connected to the case, to adjust pressure in a room between the ink bag and the case, thereby to control a nozzle internal pressure. Because a pumping height from an outlet of the nozzle to an ink liquid surface in the ink bag has influence on the nozzle internal pressure, a pump controller reads image data of those lines to be recorded later, to predict based on the image data a pumping height at a given time after. Based on the predicted pumping height, the pressure in the room is adjusted to keep the nozzle internal pressure in a predetermined range.

17 Claims, 7 Drawing Sheets

INK-JET RECORDING APPARATUS, INK CONTAINER, AND METHOD OF FILLING INK CONTAINER

FIELD OF THE INVENTION

The present invention relates to an ink-jet recording apparatus having a recording head that discharges ink to print an image. The present invention relates also to an ink container for use in the ink-jet recording apparatus, and a method of filling the ink container with the ink.

BACKGROUND OF THE INVENTION

An ink-jet recording apparatus has been known, which has a recording head for discharging ink as droplets onto a recording paper to print an image. The ink-jet recording apparatus is provided with at least an ink container containing ink, to supply the ink from the ink container to the recording head. In an example, the recording head is provided with at least a nozzle and an oscillation plate driven by a piezoelectric element. Making use of pressure change in the nozzle, which is caused by oscillating the oscillation plate, the recording head sucks the ink from the ink container into the nozzle, and discharges the ink through an ink outlet of the nozzle.

Because the ink is a consumable material, the ink container is often formed as a cartridge that is removably attached to the ink-jet recording apparatus, so as to make it easy to supplement the ink-jet recording apparatus with the ink. Such a cartridge type ink container, hereinafter called the ink cartridge, is replaced with another that is fully filled with the ink, when the ink contained in the ink cartridge is used up. In an ink cartridge loading section of the recording apparatus, an ink supply needle is disposed for supplying the ink from the ink cartridge to the recording head. The ink cartridge and the nozzle of the recording head is connected through an ink supply path, including the ink supply needle, to let the ink flow through the ink supply path.

An ink-jet recording apparatus disclosed in Japanese laid-open Patent Application No. 2003-300331 uses an ink cartridge that consists of a flexible ink bag and a case protecting the ink bag. If the ink is exposed to the air, the air will be solved in the ink, forming air bubbles in the ink, or some components of the ink react with oxygen, deteriorating the ink. To keep the air out of the ink, the ink cartridge uses the air-tight ink bag.

It is known in the art that the pressure inside the nozzle of the recording head, hereinafter called the nozzle internal pressure, is kept negative relative to the atmosphere, in order to prevent the ink leakage through the nozzle, which would otherwise be caused by the weight of the ink. Where the ink cartridge is placed above the recording head, the nozzle internal pressure is raised by the weight of the ink contained in the ink cartridge, so it cannot keep the negative value relative the atmospheric pressure without any countermeasure. According to the above prior art, the air in a room between the ink bag and the case is sucked by a suction pump to reduce the pressure in the room, so that the nozzle internal pressure is kept negative relative to the atmospheric pressure. Hereinafter, the pressure in the room between the ink bag and the case will be called the case internal pressure.

As the ink in the ink bag is consumed, the pressure applied to the nozzle by the ink weight decreases, so the negative pressure in the nozzle would become too large if the case internal pressure is kept at the initial negative value. In that case, the ink discharged from the nozzle would be improperly reduced, lowering the print density improperly. To avoid this problem, the above-mentioned prior art suggests providing a pressure sensor for measuring the nozzle internal pressure, to control sucking amount of the suction pump depending upon the measured value, so as to keep the nozzle internal pressure in a proper range.

However, the method of controlling the nozzle internal pressure while measuring it by the pressure sensor has a disadvantage that there is a delay time from the measurement by the pressure sensor to the pressure control based on the measured value. The delay of the pressure control can cause fluctuation in the ink discharging amount. Instable discharging of the ink results in uneven density of the printed image and lowers the image quality. This problem is conspicuous especially in an image of a high printing duty ratio, like a solid image.

SUMMARY OF THE INVENTION

In view of the foregoing, a primary object of the present invention is to provide an ink-jet recording apparatus that can discharge the ink stably from a recording head that is supplied with the ink from an ink bag of an ink container.

Another object of the present invention is to provide an ink container that is useful for stabilizing the ink discharging operation of the ink-jet recording apparatus.

A further object of the present invention is to provide a method of filling the ink container with the ink efficiently at a low cost.

To achieve the above and other objects, an ink-jet recording apparatus of the present invention comprises at least an ink container that comprises an ink bag containing ink and a case holding the ink bag air-tightly; a recording head placed below the ink container and supplied with the ink from the ink bag through an ink supply path, the recording head discharging the ink through at least a nozzle by an amount variable in accordance with image data to print an image; a case internal pressure adjusting device for adjusting pressure in a room between the ink bag and the case by sucking or sending air from or into the case; a pumping height predictor that predicts a consumption of the ink in a given time based on those image data to be used for printing later in the given time, and predicts based on the predicted consumption of the ink a pumping height of the ink from an outlet of the nozzle to a liquid surface of the ink in the ink bag at the given time after, while the recording head is printing the image; and a control device for controlling the case internal pressure adjusting device so as to keep pressure in the nozzle in a predetermined range, depending upon the predicted pumping height.

The present invention also suggests an ink-jet recording apparatus that comprises at least an ink container that consists of an ink bag containing ink and a case holding the ink bag air-tightly; a recording head placed below the ink container and supplied with the ink from the ink bag through an ink supply path, the recording head discharging the ink through at least a nozzle by an amount variable in accordance with image data to print an image; a case internal pressure adjusting device for adjusting pressure in a room between the ink bag and the case by sucking or sending air from or into the case; an ink flow rate predictor that predicts a flow rate of the ink that will flows through the ink supply path in a given time, based on those image data to be used for printing later in the given time, while the recording head is printing the image; a temperature sensor for measuring temperature of the ink in the ink container; an ink viscosity calculator for calculating a viscosity of the ink based on the measured ink temperature; a pressure loss calculator for calculating a pressure loss through the ink supply path based on the predicted flow rate and the calculated viscosity of the ink; and a control device for controlling the case internal pressure adjusting device based on the calculated pressure loss, so as to keep pressure in the nozzle in a predetermined range.

It is preferable to control the case internal pressure adjusting device, based on both the predicted pumping height and the calculated pressure loss.

It is also preferable to control the case internal pressure adjusting device based on a value measured by a pressure sensor measuring the pressure in the nozzle, to set the pressure in the nozzle into the predetermined range before the recording head starts printing.

According to the present invention, an ink container used for supplying ink to a recording head of an ink-jet recording apparatus, comprises an ink bag for containing the ink; and a case holding the ink bag air-tightly, the case having an ink port for feeding the ink from the ink bag out of the case, and a connecting portion for connecting the ink container to a case internal pressure adjusting device that is provided in the ink-jet recording apparatus, for adjusting pressure in a room between the ink bag and the case.

According to a preferred embodiment, the ink bag is substantially rectangular parallelepiped, and has accordion folds in its four sides, so that the ink bag is folded along the accordion folds to lower a top surface of the ink bag while keeping it approximately horizontal, as the ink contained therein is consumed. The ink bag preferably has a height in the plump-vertical direction that is less than a width and a depth of the ink bag.

According to the present invention, a method of filling an ink container with ink comprises the following steps, wherein the ink container is used for supplying the ink to a recording head of an ink-jet recording apparatus, and consists of an ink bag for containing the ink and a case holding the ink bag air-tightly, the case being provided with an ink port for feeding the ink from the ink bag out of the case, and a connecting portion for connecting the ink container to a pressure control device for controlling pressure in a room between the ink bag and the case. The inventive steps comprises the steps of connecting the pressure control device to the connecting portion; ejecting residuals from the ink bag through the ink port by raising the pressure in the room by use of the pressure control device; connecting, thereafter, an ink supply tank to the ink port; and sucking the ink from the ink supply tank into the ink bag through the ink port by reducing the pressure in the room by use of the air pump.

Since the case internal pressure is adjusted based on those values predicted from the image data to be used later for printing, the nozzle internal pressure is controlled without delay, to keep the nozzle internal pressure in the predetermined range. So the stability of ink discharging operation is improved.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
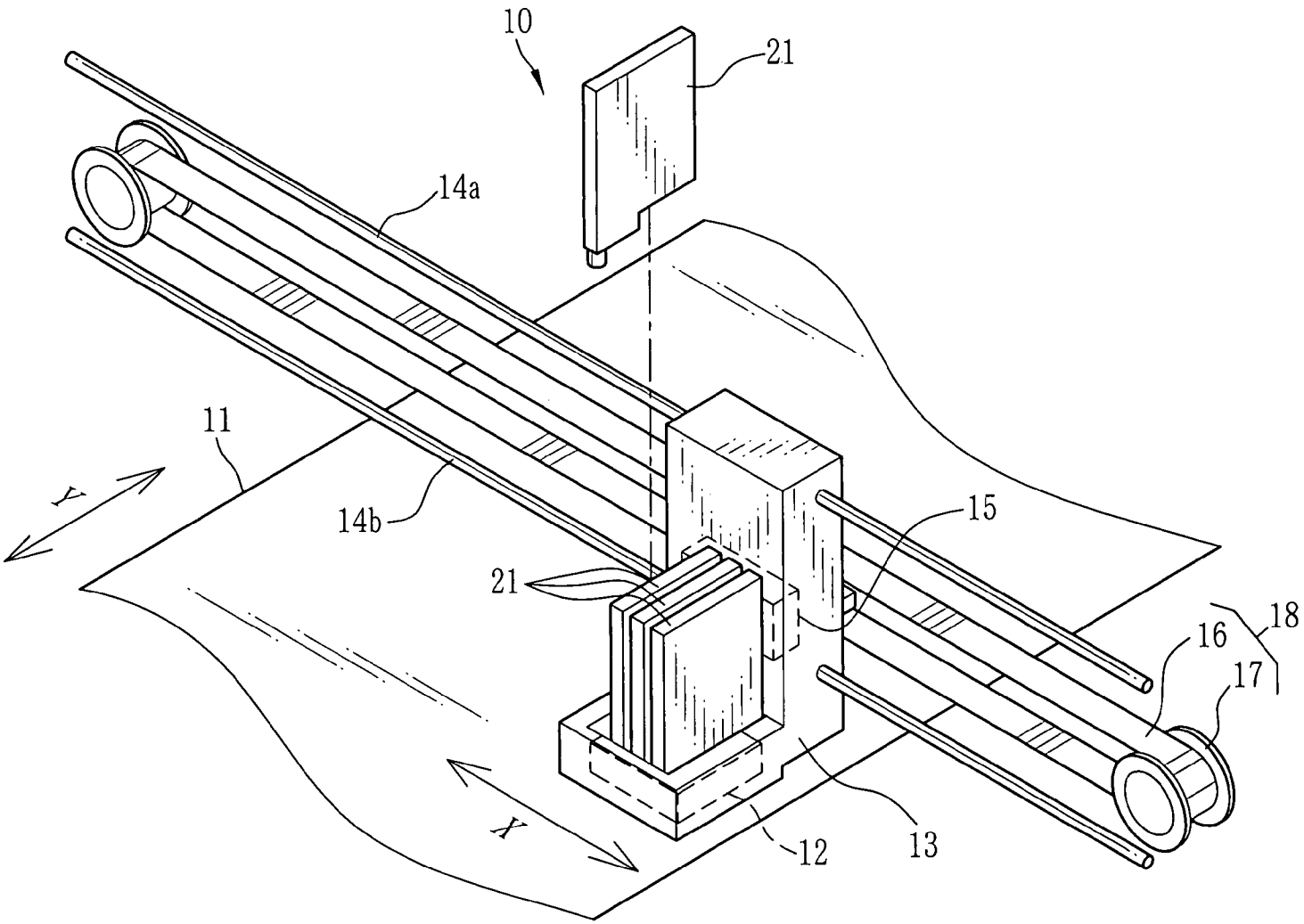
FIG. 1 is an explanatory diagram illustrating essential elements of an ink-jet recording apparatus according to an embodiment of the invention.

An ink-jet recording apparatus 10 shown in FIG. 1 is provided with a recording head 12 that discharges ink toward a paper sheet 11 to print images thereon. The recording head 12 is provided with a plurality of nozzles 12*a*, see FIG. 2, for discharging the ink from individual outlets. The outlets of the nozzles 12*a* are aligned in a plane to form a discharging surface, and the discharging surface is placed in face to a recording surface of the paper sheet 11. The recording head 12 is mounted in a carriage 13 that is movable in a widthwise direction of the paper sheet 11, that is, a main scanning direction X. The discharging surface is exposed through an opening formed through a bottom of the carriage 13. While reciprocating in the widthwise direction of the paper sheet 11 together with the carriage 13, the recording head 12 records an image in a line sequential fashion. Each time the recording head 12 makes one lap to record a line of the image, the recording paper 11 is fed by not-shown conveyer rollers in a sub scanning direction Y, that is orthogonal to the main scanning direction X, by a length corresponding to a width of each image line as recorded by the recording head 12. Thus, the image is recorded line by line.

The carriage 13 is mounted on a pair of guide rods 14*a* and 14*b* to slide thereon, and is driven by a belt mechanism 18 consisting of a belt 16 and a pair of pulleys 17. The carriage 13 carries ink cartridges 21, e.g. four cartridges containing inks of four different colors: yellow, magenta, cyan and black.

The ink cartridges 21 are removably attached to the carriage 13 by plugging them individually in not-shown slots formed above the recording head 12. When the ink cartridge 21 is plugged in the slot, an ink supply path is provided to connect the individual ink cartridge 21 to the recording head 12, permitting supplying the ink from the ink cartridge 21 to the recording head 12. The recording head 12 is provided with not-shown oscillation plates in association with the respective nozzles. The oscillation plates are driven individually by piezoelectric elements, to change pressure in the associated nozzles 12*a*. Thereby, the ink in the ink cartridge 21 is sucked into the nozzle 12*a*, and is ejected from the outlet of the nozzle 12*a*. The carriage 13 is further provided with a pump unit 15 that consists of a plurality of micro pumps 41 that are respectively connected to the ink cartridges 21, as set forth later with reference to FIG. 2.

Figure 2:
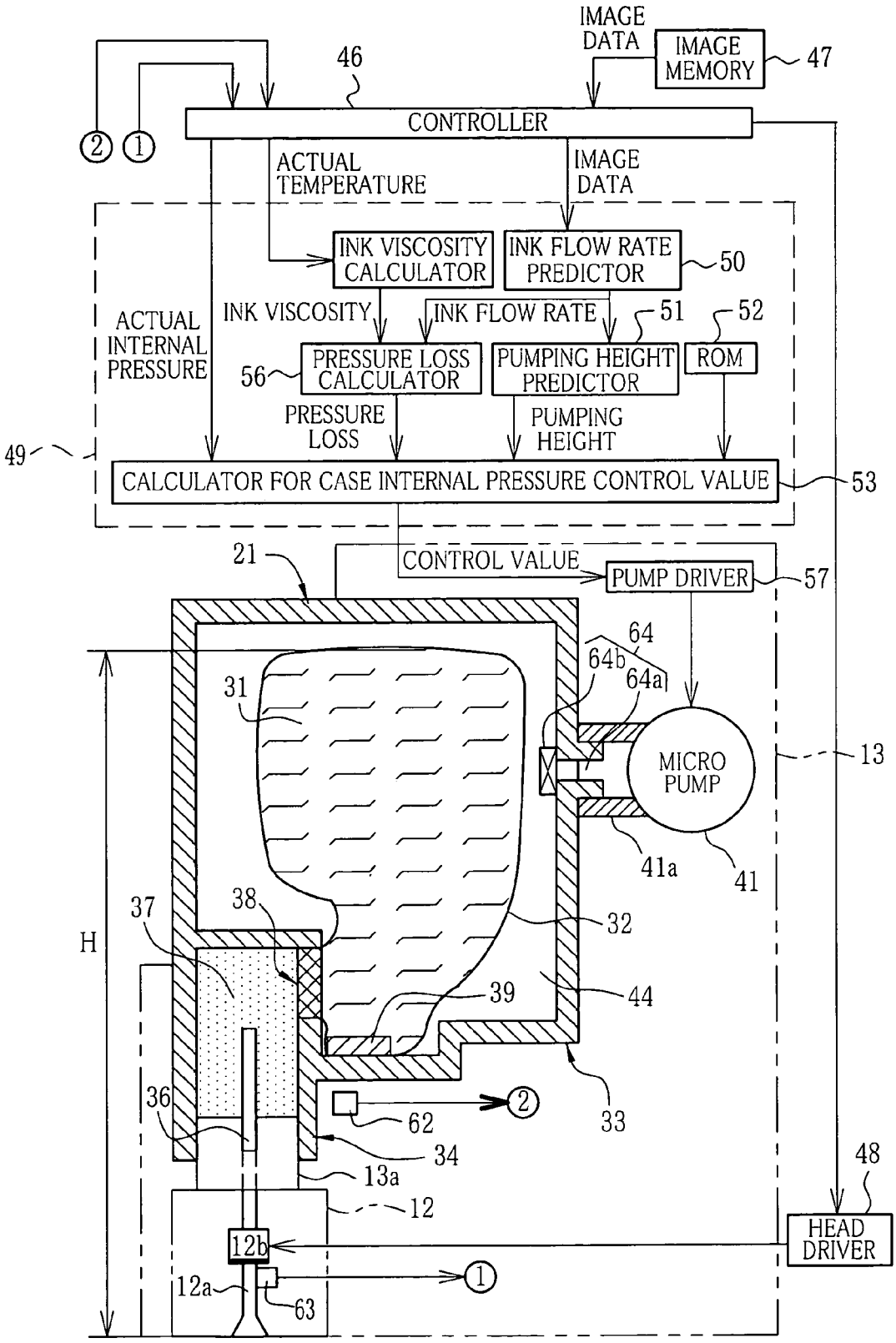
FIG. 2 is a sectional view of an ink cartridge used in the ink-jet recording apparatus of FIG. 1.

As shown in FIG. 2, the ink cartridge 21 consists of an ink bag 32 containing the ink 31, and a case 33 that holds the ink bag 32 in an air-tight fashion. The ink bag 32 is flexible and air-tight, so the ink 31 sealed in the ink bag 32 is protected from the atmosphere, so the air bubble formation in the ink and the deterioration of the ink are surely prevented.

The case 33, which may be made of a plastic, protects the ink bag 32 from the atmosphere and physical shocks. An ink port 34 is formed on a bottom side of the case 33, for supplying the ink 31 from the ink bag 32 to the recording head 12. The ink port 34 partly protrudes downward, so the protruded portion is fitted in a junction 13*a* of the carriage 13. A porous material 37, through which the ink 31 can follow, is placed in the ink port 34, and a hollow ink supply needle 36 is stuck into the porous material 37. The ink supply needle 36 forms a section of the ink supply path.

At an exit of the ink bag 32 is disposed a filter 38 for filtering the ink 31 as it flows out of the ink bag 32. This is because pigments dispersed in the ink 31 can aggregate with time in the ink bag 32, and the aggregated components of the ink can clog the nozzle 12*a* if they flow into the ink supply path. The filter 38 stops the aggregated components from flowing into the ink supply path.

A filtering surface of the filter 38 extends substantially in plumb-vertical direction. An adsorbing member 39 for the aggregated ink components is laid below the filter 38 inside the ink bag 32, with its adsorbing surface oriented horizontal. Since the adsorbing member 39 is located on the bottom of the case 33, the aggregated ink components fall down on the adsorbing member 39 and adsorbed in it. The adsorbing member 39 also adsorbs those aggregated ink components which are once stopped by the filter 38 and fall from the filter 38 onto the adsorbing member 39. As being trapped in the adsorbing member 39, the aggregated ink components are prevented from re-floating up into the ink 31.

The adsorbing member 39 is affixed on its bottom side to an inner surface portion of the ink bag 32, and the ink bag 32 adheres at its outer surface portion, which is in opposition to that inner surface portion, to the bottom wall of the case 33. Thus, the adsorbing member 39 is fixed in a predetermined position. So the ink bag 32 will not remove off the bottom wall of the case 33, keeping the adsorbing member 39 out of contact with the filter 38 and preventing the adsorbing member 39 from flapping, even after the ink bag 32 shrinks with the consumption of the ink 31.

The ink bag 32 is mounted in the case 33 with the filter 38 in contact with the porous material 37. The ink 31 in the ink bag 32 is fed out from the ink cartridge 21 through the filter 38, the porous material 37 and the ink supply needle 36.

The nozzle 12*a* of the recording head 12 is connected to the ink supply needle 36 through a not-shown supply tube, providing the ink supply path from the filter 38 through the porous material 37 and the ink supply needle 36 to the nozzle 12*a*. An actuator 12*b* is provided for each nozzle 12*a*. The actuator 12*b* consists of the piezoelectric element, the oscillation plate and a pressure room, and lets the ink sucked from the ink cartridge 21 through the ink supply path, and lets the ink discharged from the nozzle 12*a*.

A controller 46 controls overall operations of respective sections of the ink-jet recording apparatus 10. An image memory 47 memorizes image data as read from external devices such as a memory card and a digital camera into the ink-jet recording apparatus 10. The controller 46 controls a head driver 48 based on the image data, to drive the recording head 12. The head driver 48 drives the individual actuator 12*b* to discharge the ink through the nozzle 12*a* by an amount variable in accordance with the image data.

The micro pump 41 is a device for controlling a pressure in a room 44 between the inner wall of the case 33 and the ink bag 32. The ink-jet recording apparatus 10 controls the micro pump 41 to adjust the case internal pressure so as to keep a pressure inside the nozzle 12*a*, hereinafter called the nozzle internal pressure, in a negative value. The micro pump 41 is a small pump that is constituted, for example, of a piezoelectric element and a diaphragm. Since the ink cartridge 21 is placed above the nozzle 12*a*, the weight of the ink adds pressure to the nozzle 12*a*. Without any countermeasure, the ink weight would make the nozzle internal pressure positive relative to the atmosphere, so the ink would leak out through the outlet of the nozzle 12*a*.

For this reason, the case internal pressure in the room 44 is made negative by the micro pump 41, to swell the ink bag 32, and thus generate a pressure in the nozzle 12*a*, which opposes the positive pressure caused by the ink weight, so that the nozzle internal pressure is kept negative relative to the atmosphere, preventing the ink leakage. However, too much negative pressure breaks meniscuses of the ink in the nozzle 12*a*, so it is preferable to keep the nozzle internal pressure Pn in the following range where the nozzle 12*a* has an internal diameter of about 20 μm to 40 μm:

$$-2000Pa<Pn<-200Pa \quad (1)$$

wherein Pa represents the atmospheric pressure.

Note that the positive pressure Pw generated in the nozzle 12*a* by the ink weight can be expressed as ρgH, provided that H represents a height from the outlet of the nozzle 12*a* to a liquid surface inside the ink bag 32, called the pumping height, ρ represents a density of the ink, and g represents an acceleration due to gravity. Therefore, the positive pressure Pw decreases as the residual ink in the ink bag 32 decreases, that is, as the pumping height H goes down. The controller 46 is connected to a pump controller 49 for controlling the micro pump 41. The pump controller 49 controls the micro pump 41 so as to adjust the pressure in the room 44 in accordance with the change in the pressure Pw applied to the nozzle 12*a* by the ink weight.

Figure 3:
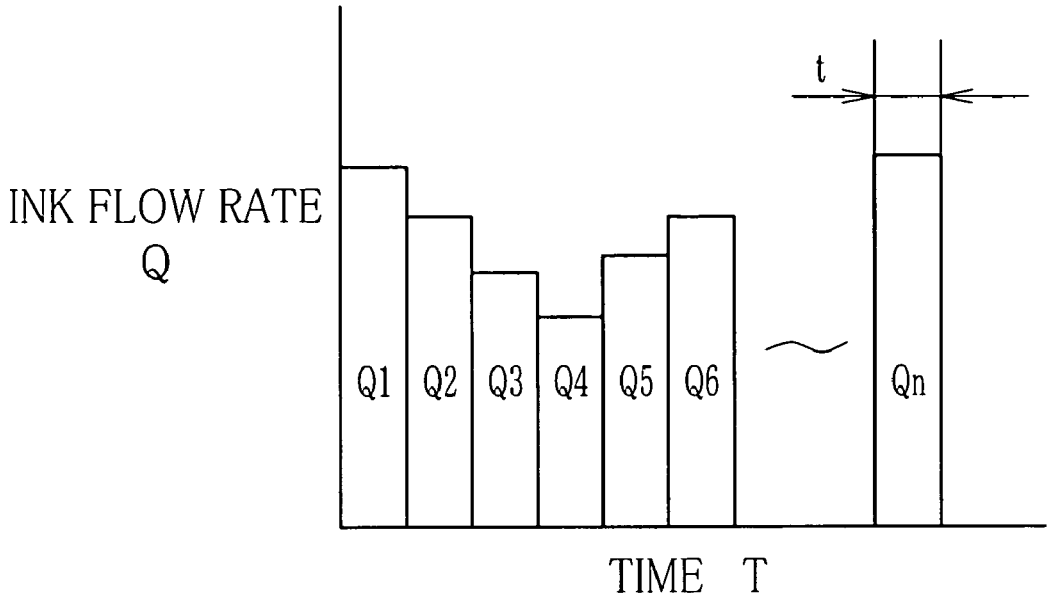
FIG. 3 is a graph illustrating variations in ink flow rate with time.

Specifically, the pump controller 49 consists of an ink flow rate predictor 50, a pumping height predictor 51, a ROM 52, a calculator for case internal pressure control value 53, an ink viscosity calculator 54 and a pressure loss calculator 56. The ink flow rate predictor 50 reads the image memory 47 to get the image data of those lines to be recorded later, and predicts based on the read image data a flow rate Q of the ink that is going to flow through the ink supply path to the recording head 12 in a given time, while the recording head 12 is recording an image. Because the ink flow rate Q corresponds to a consumed amount of the ink in the given time, the pumping height predictor 51 predicts based on the ink flow rate Q a pumping height H at the given time after. As shown in FIG. 3, the ink flow rate Q varies depending upon the image data, so the pumping height predictor 51 calculates the ink flow rate per unit time "t", e.g. 1 second, based on the image data. Because each of the calculated ink flow rates Q1 to Qn corresponds to an amount of ink consumed in the unit time, the pumping height predictor 51 reduces the calculated values Q1 to Qn sequentially from a full ink volume in the ink bag 32, to derive an ink volume remaining in the ink bag 32 at the given time after, and predicts based on the remaining ink volume a pumping height H at the given time after.

Based on the pumping height H as predicted by the pumping height predictor 51, the case internal pressure control value calculator 53 calculates the positive pressure Pw (ρgH ) applied at the given time after to the inside of the nozzle 12*a* due to the ink weight. Since the positive pressure Pw decreases as the residual ink volume in the ink bag 32 decreases, it is possible to calculate the positive pressure Pw based on the predicted pumping height H during the printing. Then the case internal pressure control value calculator 53 calculates a control value for controlling the case internal pressure Pc in accordance with a change in the positive pressure Pw, so as to keep the nozzle internal pressure Pn in the normal range as defined by the above formula (1): −2000Pa<Pn<−200Pa. With the calculated control value, the pump controller 49 controls the micro pump 41 through the pump driver 57. Concretely, as the positive pressure Pw decreases with the ink consumption, the micro pump 41 takes the air from outside into the case 33 to increase the pressure in the room 44, i.e. the case internal pressure Pc, complementarily to the reduction of the positive pressure Pw.

The recording head 12 is provided with a pressure sensor 63 for measuring the nozzle internal pressure Pn. Before the recording head 12 starts printing, the pressure sensor 63 measures the nozzle internal pressure Pn, and an actual internal pressure measured by the pressure sensor 63 is sent through the controller 46 to the case internal pressure control value calculator 53. Based on the actual internal pressure, the case internal pressure control value calculator 53 calculates a control value for the case internal pressure Pc, and the pump controller 49 drives the micro pump 41 based on the control value to adjust the case internal pressure Pc so as to set the nozzle internal pressure Pn in the above defined normal range before the start of recording. The case internal pressure Pc is controlled in this way till the nozzle internal pressure Pn is set at a proper value. The case internal pressure Pc as adjusted in this way prior to the printing is used as a reference value for the case internal pressure control value calculator 53 to calculate the control value during the printing.

The feedback control using the pressure sensor 63 permits controlling the internal pressure exactly, but involves a risk of delaying the control, which may be caused by a delay of detection by the sensor or a delay in arithmetic operation. However, because the feedback control is done before the start of printing, a little delay is no problem.

The nozzle internal pressure Pn is also affected by a pressure loss ΔP of the ink as flowing from the ink cartridge 21 to the recording head 12 through the ink supply path during the printing. The pressure loss ΔP can be calculated by the following formula:

$$\Delta P=(128\cdot Q\cdot\mu\cdot L)/(pD^4) \quad (2)$$

wherein Q represents an ink flow rate per unit time, μ represents an ink viscosity, D represents an equivalent diameter of a section where the pressure is lost, and L represents an equivalent length of the pressure lost section.

Figure 4:
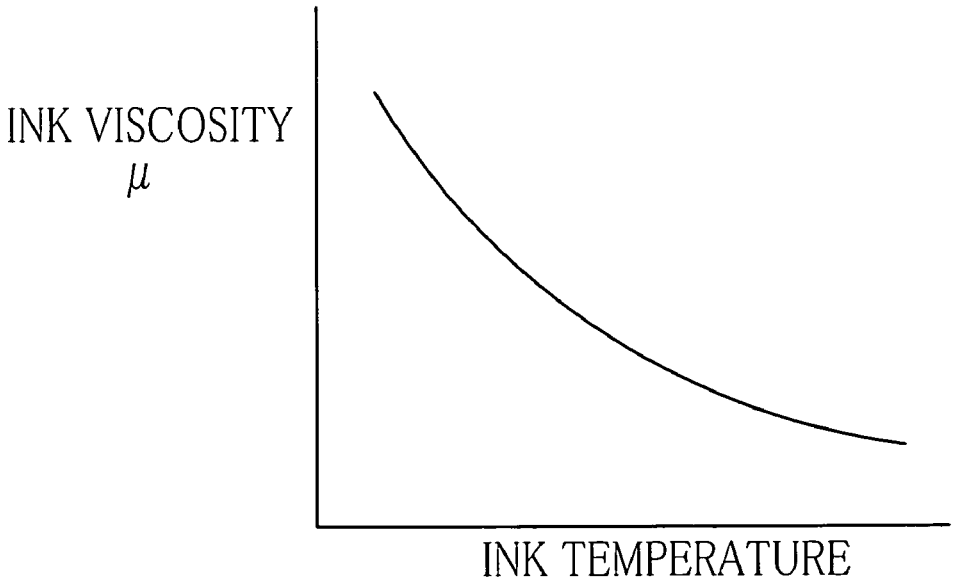
FIG. 4 is a graph illustrating a relationship between ink temperature and ink viscosity.

The pressure loss ΔP becomes so large that it cannot be ignored particularly where there are the filter 38 and the porous material 37 in the ink supply path. Moreover, the ink viscosity μ varies depending upon the ink temperature, as shown in FIG. 4. Therefore, if the ink temperature changes during the printing, the nozzle internal pressure Pn varies with the change in ink temperature, making discharge of the ink instable. For example, with an increase in the ink viscosity μ, the discharge rate and the density decrease.

For this reason, the ink-jet recording apparatus 10 takes the pressure loss ΔP into account on controlling the nozzle internal pressure Pn. A temperature sensor 62 is mounted to the carriage 13, to measure the ink temperature inside the ink cartridge 21. The ink viscosity calculator 54 calculates the ink viscosity μ based on the actual temperature measured by the temperature sensor 62. The pressure loss calculator 56 calculates the pressure loss ΔP based on the calculated ink viscosity μ in accordance with the above formula (2). The case internal pressure control value calculator 53 calculates the control value while taking account of the pressure loss ΔP in addition to the positive pressure Pw generated by the ink weight. Taking the pressure loss ΔP into consideration will correct the variations in nozzle internal pressure Pn caused by the ink temperature change, and thus stabilize the ink discharge rate in spite of the temperature change.

To take the positive pressure Pw and the pressure loss ΔP into consideration, the above-mentioned formula (1) can be modified as follows:

$$-2000Pa<Pn=Pw-Pc-\Delta P<-200Pa \quad (3)$$

Thus, the case internal pressure control value calculator 53 calculates the control value for the case internal pressure Pc relative to the reference pressure value, so that the nozzle internal pressure Pn satisfies the above condition (3). The ROM 52 stores various data to be referred to by the pump controller 49 on executing the calculations.

As described so far, the pump controller 49 measures the nozzle internal pressure Pn by the pressure sensor 63, to control the case internal pressure Pc so as to set the nozzle internal pressure Pn in the normal range in advance to the recording. During the recording, the pump controller 49 reads out the image data of those lines which are to be recorded in a given time, to control the nozzle internal pressure Pn by adjusting the case internal pressure Pc based on the image data. Therefore, the pressure control is executed without delay during the printing, so the ink is discharged more stably in comparison with the conventional method where the nozzle internal pressure is always controlled based on the measured nozzle internal pressure.

The micro pump 41 has a vent tube 41*a* that is connected to a connecting portion 64 of the case 33. The connecting portion 64 has a check valve 64*b* mounted in an air hole 64*a*. The check valve 64*b* prevents the air from entering the case 33 through the air hole 64*b* while the micro pump 41 is removed from the ink cartridge 21. When the ink cartridge 21 is attached to the carriage 13, the vent tube 41*a* of the micro pump 41 is connected to the connecting portion 64 of the case 33, and the check valve 64*b* is moved by a not-shown device, e.g. a pin mounted to a tip of the vent tube 41*a*, to open the air hole 64*a*. Then the air can flow into or out of the case 33.

The above-described pressure control is carried out for the respective nozzles 12*a* of the recording head 12 individually, in correspondence with the plurality of ink cartridges 21 loaded in the carriage 13.

Figure 5:
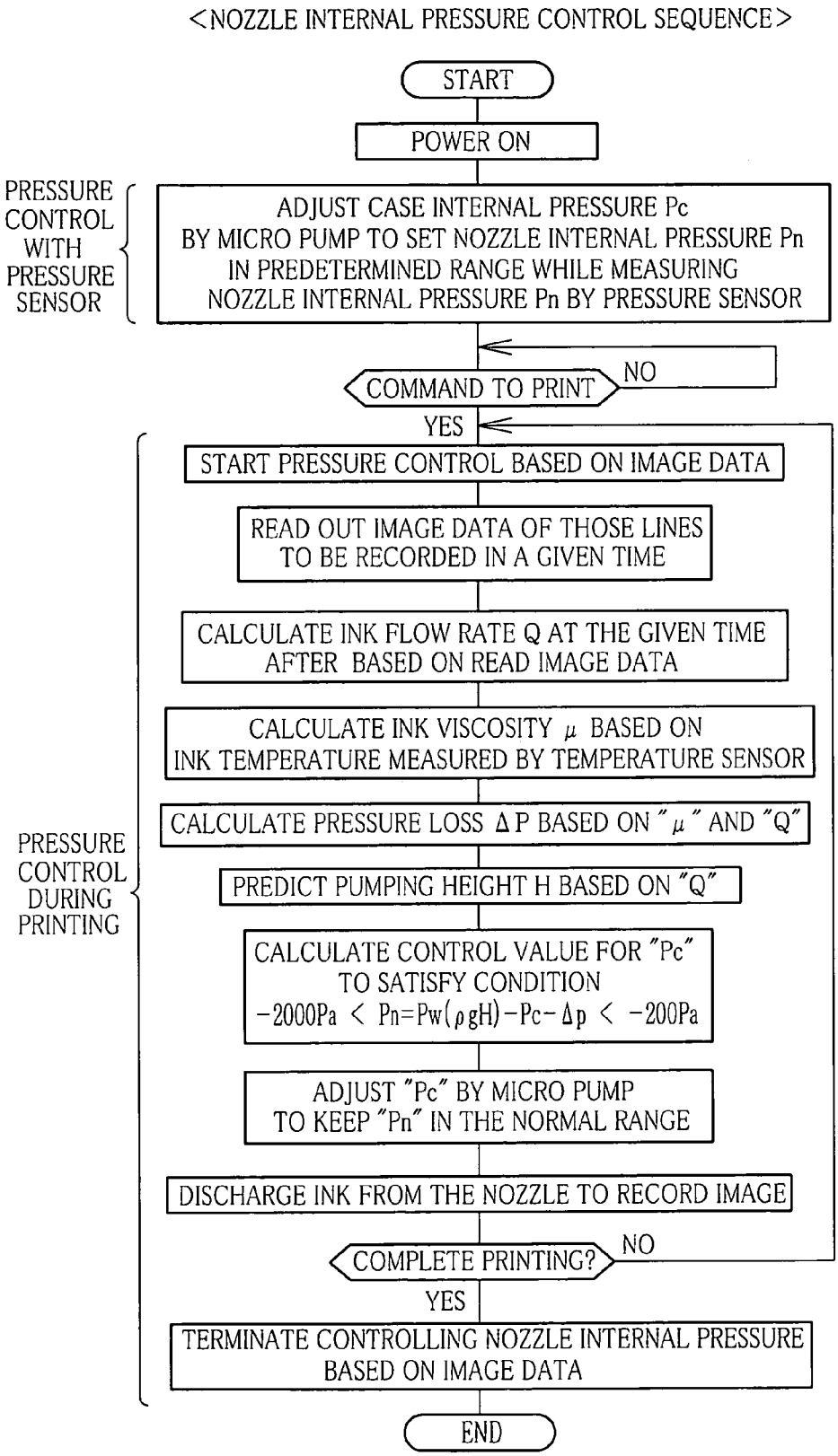
FIG. 5 is a flow chart illustrating a sequence of controlling nozzle internal pressure.

Now, the operation of the ink-jet recording apparatus 10 will be described with reference to FIG. 5.

When the ink-jet recording apparatus 10 is powered on while the ink cartridges 21 are loaded in the carriage 13, the pump controller 49 drives the micro pump 41 to adjust the case internal pressure Pc based on the nozzle internal pressure Pn measured by the pressure sensor 63, so as to set the nozzle internal pressure Pn in the predetermined normal range. When a command to print is entered after this preliminary adjusting of the case internal pressure Pc, the controller 46 starts controlling the nozzle internal pressure Pc based on the image data. The controller 46 reads the image memory 47 to get the image data of those lines which are to be recorded later in a given time, and sends the read image data to the pump controller 49.

The ink flow rate predictor 50 predicts an ink flow rate Q of the ink that will flow through the ink supply path in the given time. The ink viscosity calculator 54 calculates an ink viscosity based on an ink temperature measured by the temperature sensor 62. Based on the calculated ink viscosity μ and the predicted ink flow rate Q, the pressure loss calculator 56 calculates a pressure loss ΔP through the ink supply path in the given time. The pumping height predictor H predicts a pumping height H at the given time after, based on the predicted ink flow rate Q. Based on the predicted pumping height H, the case internal pressure control value calculator 53 calculates a positive pressure Pw caused by the ink weight, and then calculates a control value for the case internal pressure Pc so as to make the nozzle internal pressure Pn satisfy the above-mentioned condition (3). The pump controller 49 drives the micro pump 41 based on the control value to adjust the case internal pressure Pc. Thereby, the nozzle internal pressure Pn is kept in the predetermined range.

The control of the nozzle internal pressure Pn by the control value is carried out in synchronism with the recording based on the image data as previously read out for calculating the control value. The printing of the image is carried out while controlling the nozzle internal pressure in this way. As the printing is finished, the control of the nozzle internal pressure is terminated. Since the nozzle internal pressure is controlled without delay based on the previously read image data during the printing, the ink is discharged stably, preventing print density fluctuation and thus providing a high quality print.

Figure 6:
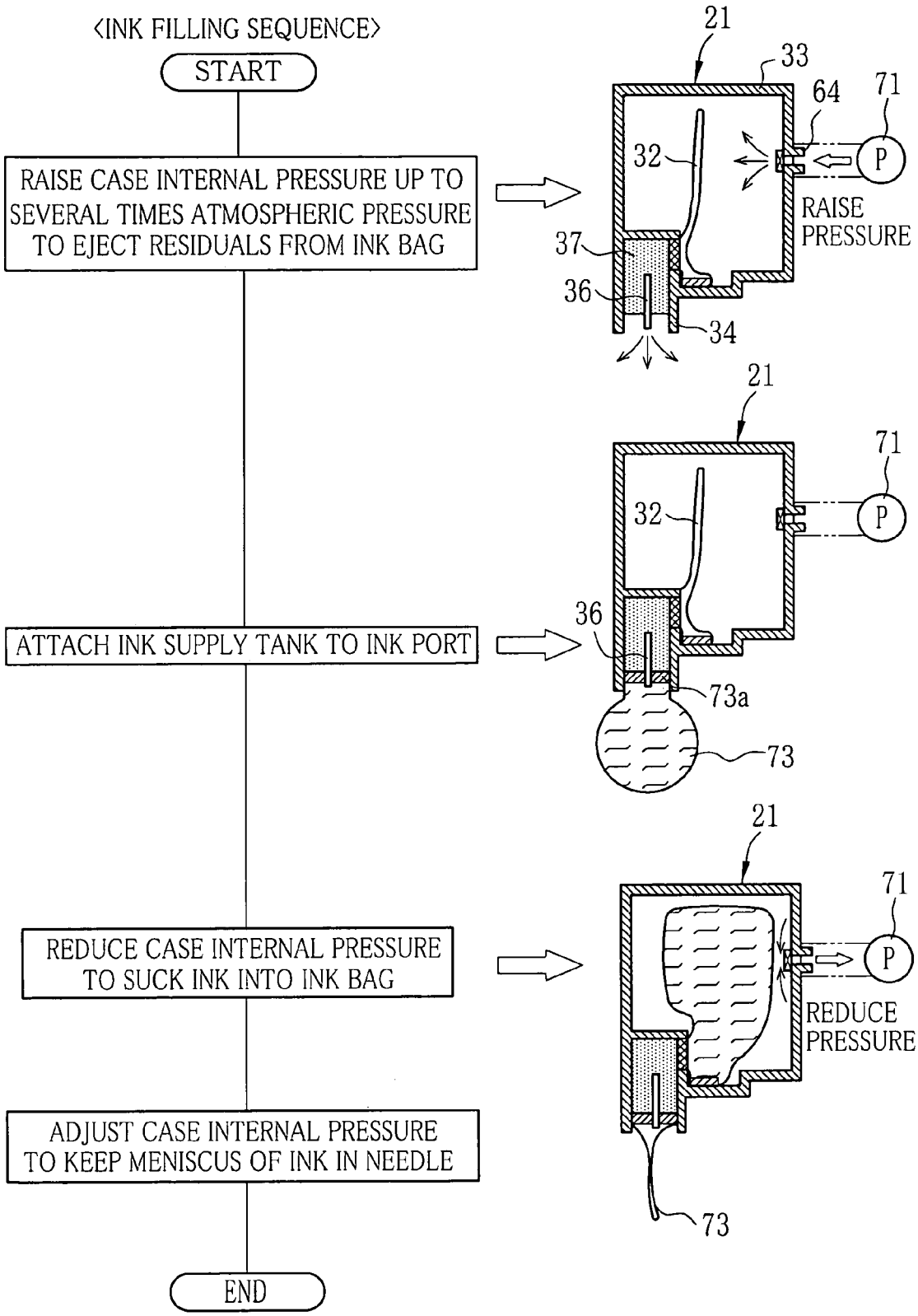
FIG. 6 is a flow chart illustrating a sequence of filling the ink cartridge with ink.

FIG. 6 shows an explanatory diagram illustrating how to fill the ink cartridge 21 with the ink. First, an ink filling pump 71 is attached to the ink port 34. The ink filling pump 71 sends the air into the case 33, to raise the case internal pressure Pc up to several times the atmospheric pressure, thereby causing the ink bag 32 to shrink and eject residual materials, including gases, from the ink bag 32 through the ink port 34.

Next, an ink supply tank 73 is attached to the ink port 34. The ink supply tank 73 is made of a flexible material so that the ink supply tank 73 shrinks as the ink contained therein is sucked into the ink cartridge 21. A rubber plug 73*a* or the like is put in an opening of the ink supply tank 73. The rubber plug 73*a* is stuck on the ink supply needle 36 till a top surface of the rubber plug 73*a* comes into tight contact with a bottom surface of the porous material 37. Thus, an ink path is provided through the ink supply needle 36 between the ink cartridge 21 and the ink supply tank 73, while keeping the joint between the ink supply tank 73 and the ink port 34 air-tight.

After the ink supply tank 73 is attached to the ink port 34, the ink filling pump 71 sucks the air from the case 33, to reduce the case internal pressure Pc. With the reduction of the case internal pressure Pc, the ink bag 32 swells to suck the ink from the ink supply tank 73 through the ink port 34. After the ink bag 32 is thus filled with the ink, the ink filling pump 71 controls the case internal pressure Pc so as to maintain the meniscus of the ink in the ink supply needle 36.

Figure 7:
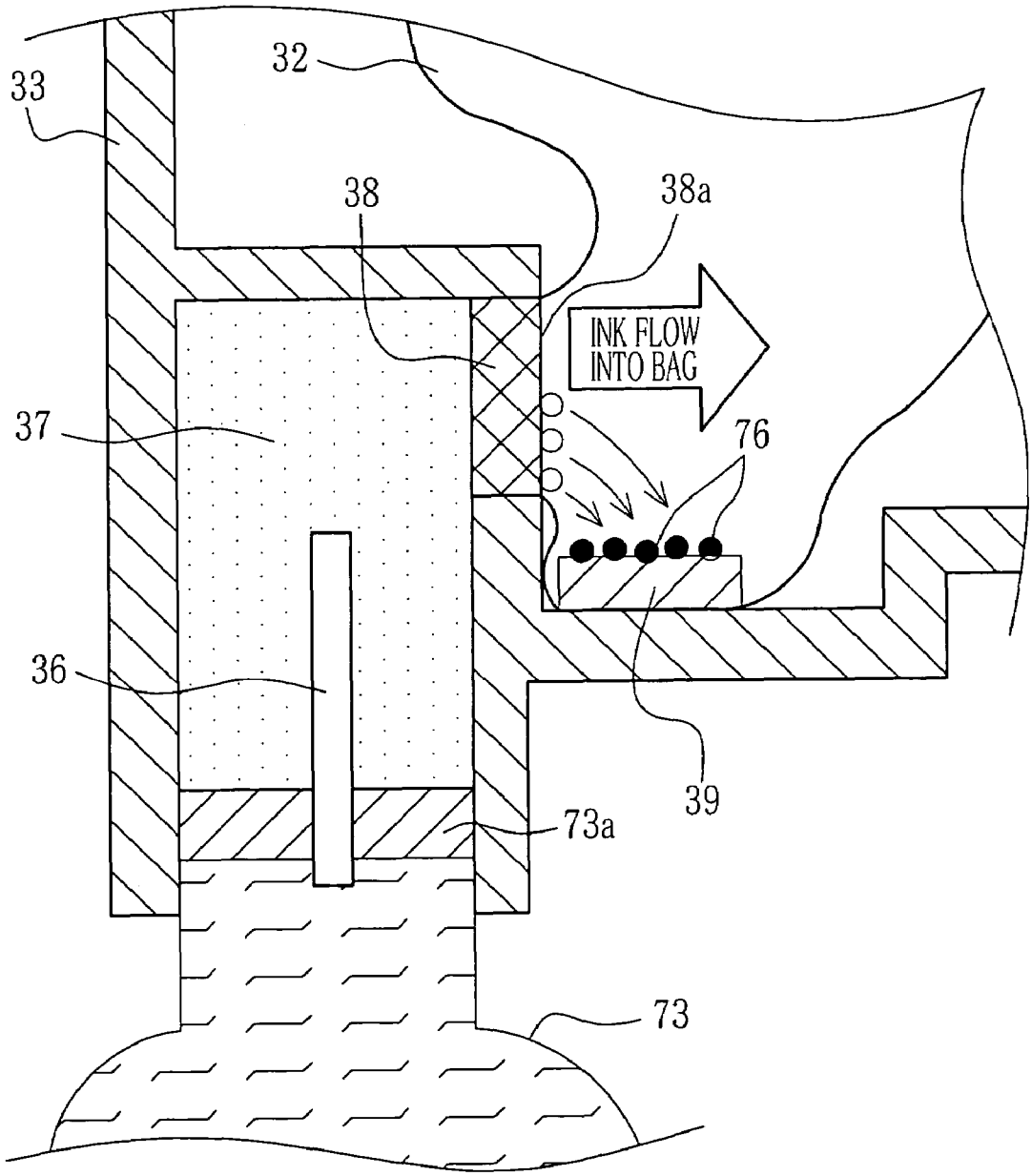
FIG. 7 is an explanatory diagram illustrating how aggregated components of the ink are adsorbed by an adsorbing member in an ink bag of the ink cartridge.

During the ink filling, the ink flows through the ink port 34 and the filter 38 into the ink bag 32, as shown in FIG. 7, in reverse to the discharging direction during the printing. If the ink cartridge 21 is refilled after once used and recovered, there may be the ink aggregated components left on an inner surface 38*a* of the filter 38. In that case, the aggregated components 76 are removed from the filter surface 38*a* by a pressure caused by the ink flowing through the filter 38 into the ink bag 32, and the removed aggregated components 76 drop onto the adsorbing member 39 below the filter 38. So the adsorbing member 39 traps the aggregated components 76.

Figure 8A:
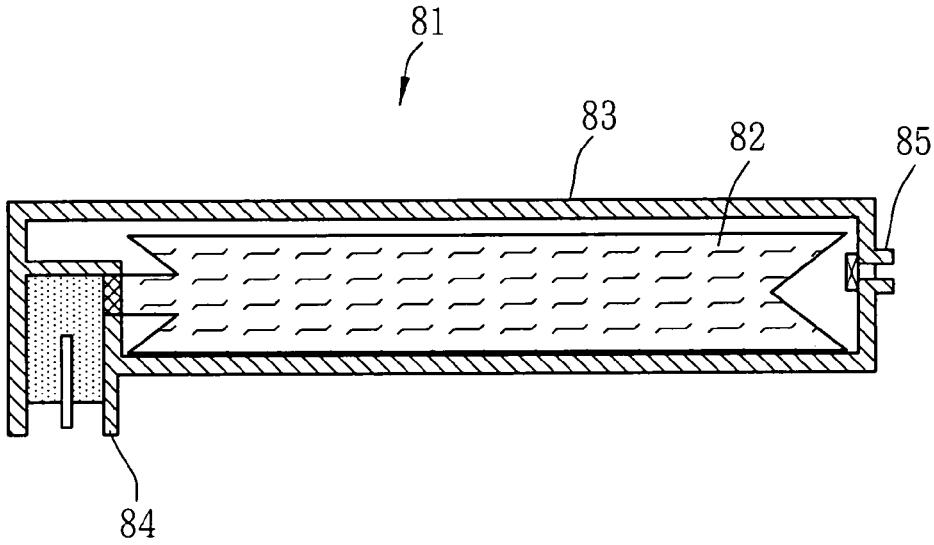
FIG. 8A is a sectional view of an ink cartridge according to a second embodiment.
Figure 8B:
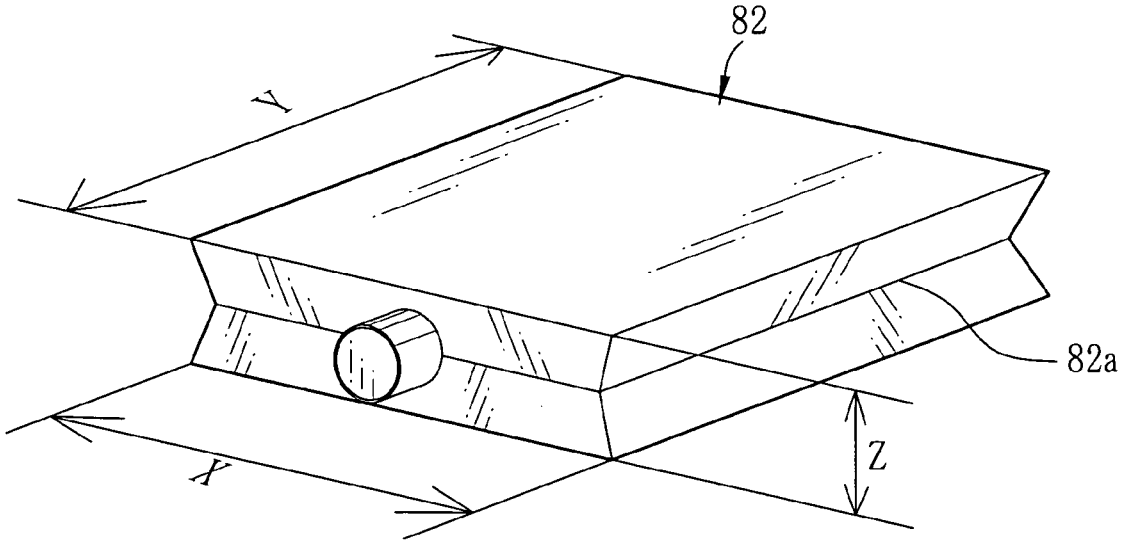
FIG. 8B is a perspective view of an ink bag of the ink cartridge of the second embodiment.

FIG. 8 shows an ink cartridge 81 of another kind. Like the ink cartridge 21 of the above embodiment, the ink cartridge 81 consists of an ink bag 82 and a case 82 that is provided with an ink port 84 and a joint portion 85. The ink bag 82 is substantially rectangular parallelepiped, whose height Z in the plump-vertical direction is less than a width X and a depth Y of the ink bag 82.

Reducing the height Z of the ink bag 82 makes it possible to lower the maximum pumping height H and thus the maximum positive pressure Pw caused by the ink weight. The smaller the positive pressure Pw, the smaller the absolute value of the negative pressure can be, which is to be generated in the case 83 to cancel the positive pressure Pw. Accordingly, it becomes possible to use a micro pump of a smaller power for generating the negative pressure in the case 83. Since the negative pressure to be generated in the case 83 is small, the case 83 needs to be less air-tight, so the case 83 can be made of a cheaper material, saving the cost of parts of the ink cartridge 81. Besides, the flat ink cartridge 81 makes it possible to reduce the height of the ink-jet recording apparatus.

The ink bag 82 has accordion folds 82*a* in its four sides. Thanks to these accordion folds 82*a*, the ink bag 82 reduces its volume while being folded along the accordion folds 82*a*. Accordingly, as the ink contained in the ink bag 82 is consumed, the ink bag 82 reduces its height Z while keeping its top surface approximately horizontal. So the displacement of the liquid surface of the ink inside the ink bag 82, i.e. the change of the pumping height H, becomes more proportional to the volume of the residual ink. As a result, it becomes possible to control the nozzle internal pressure more precisely in accordance with the positive pressure Pw that varies depending upon the ink weight.

The height Z of the ink bag 82 is preferably not more than 50 mm or so at the maximum. Because the height Z has a relation to the displacement of the pumping height H, the positive pressure Pw changes so gently with the ink consumption where the height Z is 50 mm or so, when the ink bag 82 is fully filled with the ink. In that case, it may be possible to disregard the positive pressure Pw on controlling the nozzle internal pressure.

Although the nozzle internal pressure is controlled based on both the positive pressure applied to the nozzle by the ink weight and the pressure loss through the ink supply path in the above embodiment, it is possible to control the nozzle internal pressure based on only one of these two factors.

Although the present invention has been described with respect to the embodiment wherein the inks of different colors are supplied from the ink cartridges that are removably connected to the recording head, the present invention is applicable to an ink-jet recording apparatus using a single ink cartridge for supplying ink of one color, or an ink-jet recording apparatus wherein at least an ink container is formed integrally with a recording head. So the ink container of the present invention is not limited to the ink cartridge, but may be formed integrally with a recording head.

Thus the present invention is not to be limited to the above-described embodiments, but various modifications will be possible without departing from the scope of claims as appended hereto.

What is claimed is:

1. An ink-jet recording apparatus comprising:

an ink container that comprises an ink bag containing ink and a case holding said ink bag air-tightly;

a recording head placed below said ink container and supplied with the ink from said ink bag through an ink supply path, said recording head discharging the ink through a nozzle by an amount variable in accordance with image data to print an image;

a case internal pressure adjusting device for adjusting pressure in a space between said ink bag and said case by sucking or sending air from or into said case;

a pumping height predictor that predicts a consumption of the ink in a given time based on image data to be used for printing later in the given time, and predicts based on the predicted consumption of the ink a pumping height of the ink from an outlet of said nozzle to a liquid surface of the ink in said ink bag at the given time after, while said recording head is printing the image; and a control device for controlling said case internal pressure adjusting device so as to keep pressure in said nozzle in a predetermined range, depending upon the predicted pumping height.

2. An ink-jet recording apparatus as claimed in claim 1, wherein said case internal pressure adjusting device comprises a micro pump.

3. An ink-jet recording apparatus as claimed in claim 1, further comprising:

a temperature sensor for measuring temperature of the ink in said ink container;

an ink viscosity calculator for calculating a viscosity of the ink based on the measured ink temperature; and a pressure loss calculator for calculating a pressure loss through said ink supply path based on the calculated viscosity of the ink, wherein said control device controls said case internal pressure adjusting device, taking account of the calculated pressure loss.

4. An ink-jet recording apparatus as claimed in claim 3, wherein said nozzle has an internal diameter of about 20 μm to 40 μm, and said control device controls said case internal pressure adjusting device such that the pressure in said nozzle satisfies the following condition:

$$-2000Pa<Pn=Pw-Pc-\Delta P<-200Pa$$

wherein Pa represents an atmospheric pressure, Pn the pressure in said nozzle, Pw a positive pressure generated in said nozzle by a weight of the ink, Pc the pressure in said space, and ΔP a pressure loss through said ink supply path.

5. An ink-jet recording apparatus as claimed in claim 1, wherein said ink supply path comprises a hollow ink supply needle that connects said ink container to said recording head, and a filter for filtering the ink as the ink flows out of said ink bag.

6. An ink-jet recording apparatus as claimed in claim 1, further comprising a pressure sensor for measuring the pressure in said nozzle, wherein said control device controls said case internal pressure adjusting device based on a value measured by said pressure sensor, to set the pressure in said nozzle into said predetermined range, before said recording head starts printing.

7. An ink-jet recording apparatus comprising:

an ink container that comprises an ink bag containing ink and a case holding said ink bag air-tightly;

a recording head placed below said ink container and supplied with the ink from said ink bag through an ink supply path, said recording head discharging the ink through a nozzle by an amount variable in accordance with image data to print an image;

a case internal pressure adjusting device for adjusting pressure in space between said ink bag and said case by sucking or sending air from or into said case;

an ink flow rate predictor that predicts a flow rate of the ink that will flow through said ink supply path in a given time, based on image data to be used for printing later in the given time, while said recording head is printing the image;

a temperature sensor for measuring temperature of the ink in said ink container;

an ink viscosity calculator for calculating a viscosity of the ink based on the measured ink temperature;

a pressure loss calculator for calculating a pressure loss through said ink supply path based on the predicted flow rate and the calculated viscosity of the ink; and a control device for controlling said case internal pressure adjusting device based on the calculated pressure loss, so as to keep pressure in said nozzle in a predetermined range.

8. An ink container used for supplying ink to a recording head of an ink-jet recording apparatus, comprising:

an ink bag for containing the ink;

a case holding said ink bag air-tightly, said case having an ink port for feeding the ink from said ink bag out of said case, and a connecting portion for connecting said ink container to a case internal pressure adjusting device that is provided in said ink-jet recording apparatus, for adjusting pressure in a space between said ink bag and said case; and a filter for filtering the ink as it is fed out from said ink bag, wherein said filter has a filtering surface that is positioned substantially plumb-vertically at an exit of said ink bag, and said ink container further comprises an adsorbing member laid below said filter inside said ink bag, an adsorbing surface of said adsorbing member being positioned substantially horizontally, for absorbing unnecessary contents in the ink, which are stopped by said filter and fall from said filter.

9. An ink container as claimed in claim 8, wherein said ink container is removably mounted in said ink-jet recording apparatus.

10. An ink container as claimed in claim 8, wherein said case internal pressure adjusting device is a pump sucking or sending air from or into said case.

11. An ink container as claimed in claim 8, further comprising a check valve mounted in said connecting portion, for stopping the air from entering said case while said case internal pressure adjusting device is not connected to said ink container.

12. An ink container as claimed in claim 8, wherein said ink bag is substantially rectangular parallelepiped, and has accordion folds in its four sides, so that said ink bag is folded along said accordion folds to lower a top surface of said ink bag while keeping it approximately horizontal, as the ink contained therein is consumed.

13. An ink container as claimed in claim 8, wherein a height in the plump-vertical direction of said ink bag is less than a width and a depth of said ink bag.

14. An ink container as claimed in claim 8, wherein the height of said ink bag in the plump-vertical direction is not more than approximately 50 mm.

15. A method of filling an ink container with ink, wherein said ink container is used for supplying the ink to a recording head of an ink-jet recording apparatus, and comprises an ink bag for containing the ink and a case holding said ink bag air-tightly, said case being provided with an ink port for feeding the ink from said ink bag out of said case, and a connecting portion for connecting said ink container to a pressure control device for controlling pressure in a space between said ink bag and said case, said method comprising steps of:

connecting said pressure control device to said connecting portion;

ejecting residuals from said ink bag through said ink port by raising the pressure in said space by use of said pressure control device;

connecting, thereafter, an ink supply tank to said ink port; and sucking the ink from said ink supply tank into said ink bag through said ink port by reducing the pressure in said space by use of said pressure control device.

16. An ink-jet recording apparatus comprising:

an ink container that comprises an ink bag containing ink and a case holding said ink bag air-tightly;

a recording head placed below said ink container and supplied with the ink from said ink bag through an ink supply path, said recording head discharging the ink through a nozzle by an amount variable in accordance with image data to print an image;

a case internal pressure adjusting device for adjusting pressure in a space between said ink bag and said case by sucking or sending air from or into said case;

a pumping height predictor that predicts a consumption of the ink per unit time in a given time based on image data to be used for printing later in the given time, and predicts based on the predicted consumption of the ink a pumping height of the ink from an outlet of said nozzle to a liquid surface of the ink in said ink bag at the given time after, while said recording head is printing the image; and a control device for controlling said case internal pressure adjusting device so as to keep pressure in said nozzle in a predetermined range, depending upon the predicted pumping height.

17. An ink-jet recording apparatus comprising:

an ink container that comprises an ink bag containing ink and a case holding said ink bag air-tightly;

a recording head placed below said ink container and supplied with the ink from said ink bag through an ink supply path, said recording head discharging the ink through a nozzle by an amount variable in accordance with image data to print an image;

a case internal pressure adjusting device for adjusting pressure in a space between said ink bag and said case by sucking or sending air from or into said case;

an ink flow rate predictor that predicts a flow rate of the ink that will flow through said ink supply path per unit time in a given time, based on image data to be used for printing later in the given time, while said recording head is printing the image;

a temperature sensor for measuring temperature of the ink in said ink container;

an ink viscosity calculator for calculating a viscosity of the ink based on the measured ink temperature;

a pressure loss calculator for calculating a pressure loss through said ink supply path based on the predicted flow rate and the calculated viscosity of the ink; and a control device for controlling said case internal pressure adjusting device based on the calculated pressure loss, so as to keep pressure in said nozzle in a predetermined range.

* * * * *